US012453903B2

(12) United States Patent
Morales

(10) Patent No.: US 12,453,903 B2
(45) Date of Patent: Oct. 28, 2025

(54) MULTI-AXIS BALANCE TRAINER

(71) Applicant: Hector Morales, Delray Beach, FL (US)

(72) Inventor: Hector Morales, Delray Beach, FL (US)

( * ) Notice: Subject to any disclaimer, the term of this patent is extended or adjusted under 35 U.S.C. 154(b) by 64 days.

(21) Appl. No.: 18/438,287

(22) Filed: Feb. 9, 2024

(65) Prior Publication Data

US 2025/0256160 A1 Aug. 14, 2025

(51) Int. Cl.
*A63B 26/00* (2006.01)
*A63B 22/18* (2006.01)

(52) U.S. Cl.
CPC ..... *A63B 26/003* (2013.01); *A63B 22/18* (2013.01)

(58) Field of Classification Search
CPC ..... A63B 21/068; A63B 21/4015; A63B 21/4034; A63B 22/14; A63B 22/16; A63B 22/18; A63B 26/00; A63B 26/003
See application file for complete search history.

(56) References Cited

U.S. PATENT DOCUMENTS 4,613,131 A * 9/1986 Anderson ..... B63B 34/50 441/67
4,801,140 A * 1/1989 Bergeron ..... A63B 21/0004 280/87.01
5,048,823 A * 9/1991 Bean ..... A63B 22/18 482/146
5,343,636 A * 9/1994 Sabol ..... A43B 13/18 36/7.8
6,422,983 B1 * 7/2002 Weck ..... A63B 22/18 482/148
6,551,225 B1 * 4/2003 Romero ..... A63B 22/18 482/79
6,575,885 B1 * 6/2003 Weck ..... A63B 21/0004 482/148
7,500,324 B1 * 3/2009 Power ..... A43B 13/145 482/79
8,814,768 B1 * 8/2014 Yang ..... A63B 21/068 482/121
9,370,705 B2 * 6/2016 Grzesiak ..... F16L 3/23
(Continued)

FOREIGN PATENT DOCUMENTS

CZ 20443 U1 * 1/2010
CZ 50962009 U1 * 11/2010
(Continued)

*Primary Examiner* — Gary D Urbiel Goldner

(57) ABSTRACT

The present invention is a modular multi-axis balance trainer that includes a substantially flat deck forming a top portion having a substantially rigid member for stepping. A rigid bottom member is arranged beneath the substantially flat deck. The rigid bottom member is substantially dome-shaped and is configured to be placed on a surface. The rigid bottom member is configured to induce rotational instability on a user stepping on the substantially flat deck to challenge a balance of the user. The modular multi-axis balance trainer also includes a transversely extending opening that allows an insertion of a foot strap, securing the user during dynamic balance exercises. Additional features of the modular multi-axis balance trainer include thermoplastic polyurethane construction for the deck and dome structures, resilience to deformation, and multi-axial rotations enabled by the dome shape.

10 Claims, 3 Drawing Sheets

(56) References Cited

U.S. PATENT DOCUMENTS

| | | | | |
|---|---|---|---|---|
| 9,950,241 | B2 * | 4/2018 | Pfeifer | A63C 10/14 |
| 11,439,867 | B1 * | 9/2022 | Sama | A63B 22/18 |
| 2003/0148865 | A1 * | 8/2003 | Handshoe | A63B 22/18<br>482/79 |
| 2004/0014571 | A1 * | 1/2004 | Haynes | A63B 26/003<br>482/142 |
| 2004/0018924 | A1 * | 1/2004 | Szydlowski | A63B 22/18<br>482/146 |
| 2013/0288866 | A1 * | 10/2013 | Rainey | A63B 22/18<br>482/146 |
| 2013/0316886 | A1 * | 11/2013 | Lynch | A63B 21/4035<br>482/146 |
| 2018/0200569 | A1 * | 7/2018 | Blitstein | A63B 26/003 |
| 2022/0257998 | A1 * | 8/2022 | Lagioia | A63B 21/002 |
| 2023/0232934 | A1 * | 7/2023 | Lightheart | A43B 5/00<br>36/114 |
| 2024/0131389 | A1 * | 4/2024 | Lagioia | A63B 21/002 |

FOREIGN PATENT DOCUMENTS

| | | | | |
|---|---|---|---|---|
| CZ | 34395 | U1 * | 9/2020 | |
| DE | 4304331 | C2 * | 8/1994 | A63B 21/0004 |
| DE | 20205930 | U1 * | 8/2002 | A63B 21/0004 |
| DE | 10252894 | A1 * | 5/2004 | A61H 1/0266 |
| DE | 202014102573 | U1 * | 8/2014 | A63B 21/028 |
| FR | 2824482 | A3 * | 11/2002 | A63B 21/0004 |
| FR | 2834470 | A1 * | 7/2003 | A63B 22/16 |
| GB | 2144646 | A * | 3/1985 | A63B 21/0004 |
| WO | WO-2018172800 | A1 * | 9/2018 | |

* cited by examiner

MULTI-AXIS BALANCE TRAINER

FIELD OF INVENTION

The present invention relates to to the field of physical fitness and rehabilitation equipment, specifically focusing on balance and stability training. More specifically, the invention discloses a multi-axis balance trainer that enhances core strength, coordination, and proprioception. The device caters to various skill levels and is designed for both fitness enthusiasts and individuals undergoing physical rehabilitation, offering adjustable instability and a compact, versatile form.

BACKGROUND OF THE INVENTION

In the realm of physical fitness and rehabilitation, balance trainers have emerged as essential tools for enhancing core strength, coordination, and proprioceptive skills. The current state of the art in balance trainers predominantly includes devices that permit movement and stabilization exercises across limited planes. These conventional trainers typically feature a fixed base with a flat or slightly curved surface upon which individuals stand, sit, or perform various exercises. The design of these trainers, while effective to a certain degree, primarily focuses on a restricted range of motion, primarily in the anterior-posterior or lateral planes. This limitation is reflective of an inherent gap in simulating the complex, multi-directional movements encountered in everyday activities and sports.

The disadvantage of such a constrained range of motion is significant, particularly when considering the dynamic nature of human movement in various real-life scenarios. Current balance trainers inadequately replicate the multidirectional instability that individuals face in sports, daily activities, and in the process of rehabilitation from injuries. This lack of comprehensive instability training can lead to a shortfall in effectively strengthening the core muscles and improving overall balance and proprioception. Additionally, the majority of existing balance trainers do not offer adjustable levels of instability. This one-size-fits-all approach limits their effectiveness across different skill levels, from beginners to advanced athletes, as well as their adaptability to various stages of physical rehabilitation.

Moreover, the current designs predominantly lack compactness and adjustability in one unified package. While some trainers offer a degree of adjustability, they often require cumbersome or time-consuming modifications to change instability levels or training modes. This lack of ease in adjustability and the absence of a compact, all-encompassing design deter their practicality for users who seek a versatile and space-efficient training tool. Whether in a home setting or a professional environment, the need for a balance trainer that is both adjustable and compact remains unmet, limiting the scope of balance training that can be achieved with existing equipment.

It is therefore an objective of the present invention to address these shortcomings by introducing a novel balance training device. This device aims to bridge the gap in the current technology by offering a multi-axis, adjustable mechanism that can simulate the multidirectional instability encountered in real-world situations. The design is envisioned to be compact and versatile, catering to a wide range of users across different skill levels and training needs, thereby enhancing the efficacy of balance training in both fitness and rehabilitation contexts.

SUMMARY OF THE INVENTION

The following summary is an explanation of some of the general inventive steps for the invention in the description. This summary is not an extensive overview of the invention and does not intend to limit its scope beyond what is described and claimed as a summary.

In some aspects thereof, the present invention discloses a balance training device, designed to enhance fitness and rehabilitation equipment. In some aspects, this compact device, preferably made from durable and resilient Thermoplastic Polyurethane (TPU), presents a novel approach to balance training by allowing users to adjust instability levels across multiple axes. An objective of the present invention is to significantly enhance core strength, proprioceptive abilities, and overall bodily coordination.

According to one aspect, the trainer's unique geometrical design of is one of its standout features, optimized to provide superior proprioceptive feedback and stability training. This design is not just a visual appeal but is engineered to interact efficiently with the user's body, offering a training experience that closely mimics real-world movements and challenges. The invention's effectiveness in engaging core muscles is markedly enhanced compared to conventional balance training equipment. Its adaptability in terms of difficulty levels ensures that it remains a relevant and challenging apparatus for users as they progress in their training, whether in personal fitness routines or rehabilitation programs.

In one non-limiting embodiment, his invention describes a modular balance trainer. This embodiment encompasses a substantially flat deck as the top portion, constructed from a substantially rigid material, ideal for stepping and various exercise activities. Preferably, the incorporation of anti-slip tracks on the flat deck surface addresses safety concerns, providing a secure and stable platform for users during their training sessions. This feature is particularly useful in ensuring that the device can be used confidently and effectively across different age groups and skill levels.

In a non-limiting aspect, the invention further comprises a bottom member of the trainer, which is substantially dome-shaped. This design is not merely aesthetic but functional, as it induces a rotational force on the trainer when placed on a level surface. A preferable functional feature of the dome shape is the adjustability of the rigidity of this bottom member. By increasing or decreasing the rigidity, users can control the level of rotational force, thereby customizing the intensity of their balance training. This feature contributes to the invention's ability to offer a tailored training experience to each user.

In another non-limiting aspect, the bottom member's rigidity is adjustable through an inflatable chamber. This chamber, enclosed by an outer layer of the bottom member, may be easily adjusted in terms of air pressure through an inflation nozzle. This allows users to swiftly and effortlessly increase or decrease the rigidity of the bottom member, thereby modifying the trainer's stability. This feature not only adds to the versatility of the device but also makes it incredibly user-friendly.

In addition to these features, the invention preferably incorporates a handle arranged substantially towards the top member, enhancing its portability and ease of storage. Furthermore, the top and bottom members may be designed to be separable, adding to the convenience of transport and storage. Such an aspect of the design may that the device can be used in various settings, from compact home environments to professional training facilities, without any logistical challenges.

Therefore, this invention presents a significant advancement in balance training technology. Its combination of a unique geometrical design, adjustable instability features, and user-centric aspects positions it as a highly effective and versatile tool in the realms of fitness and rehabilitation.

BRIEF DESCRIPTION OF THE DRAWINGS

The novel features believed to be characteristic of the illustrative embodiments are set forth in the appended claims. The illustrative embodiments, however, as well as a preferred mode of use, further objectives and descriptions thereof, will best be understood by reference to the following detailed description of one or more illustrative embodiments of the present disclosure when read in conjunction with the accompanying drawings, wherein:

DETAILED DESCRIPTION OF THE PREFERRED EMBODIMENTS

Hereinafter, the preferred embodiment of the present invention will be described in detail and reference made to the accompanying drawings. The terminologies or words used in the description and the claims of the present invention should not be interpreted as being limited merely to their common and dictionary meanings. On the contrary, they should be interpreted based on the meanings and concepts of the invention in keeping with the scope of the invention based on the principle that the inventor(s) can appropriately define the terms in order to describe the invention in the best way.

It is to be understood that the form of the invention shown and described herein is to be taken as a preferred embodiment of the present invention, so it does not express the technical spirit and scope of this invention. Accordingly, it should be understood that various changes and modifications may be made to the invention without departing from the spirit and scope thereof.

Figure 1:
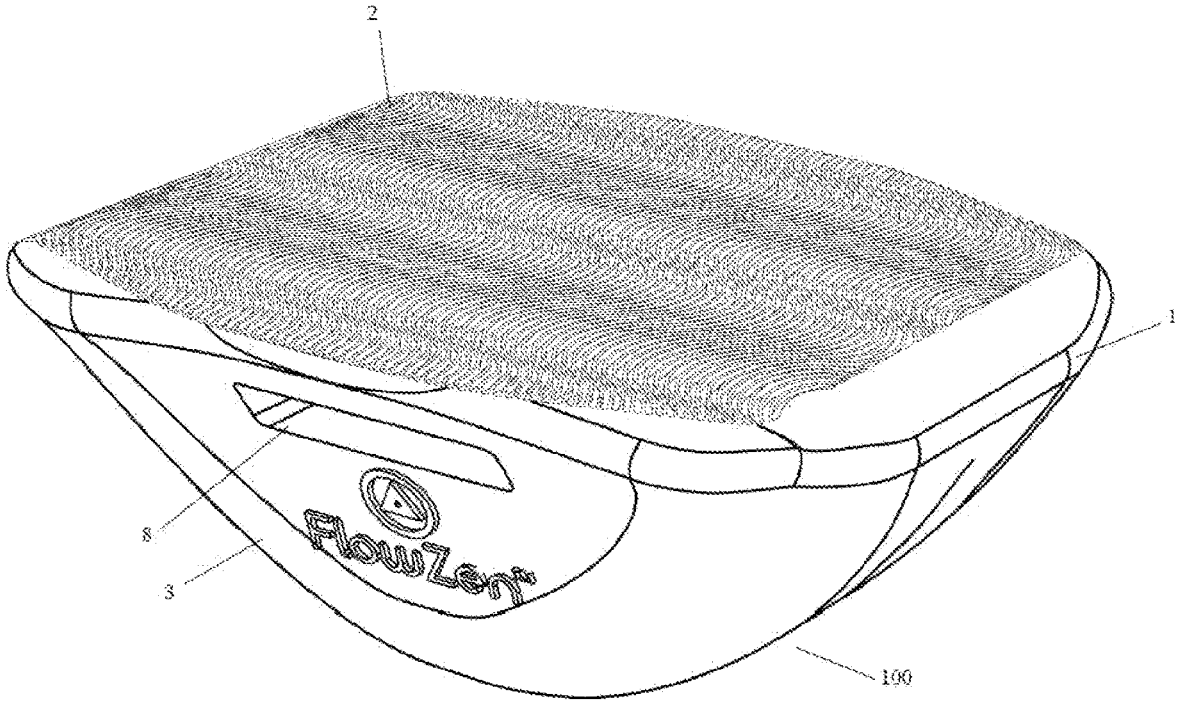
FIG. 1 depicts perspective view of the trainer according to one aspect.

The non-limiting embodiment according to FIG. 1 illustrates a perspective view of the multi-axis balance trainer (100) according to one aspect. As shown, the trainer (100) comprises a substantially flat deck (1) forming the top portion thereof. This flat deck (1) constitutes a rigid platform made of durable material such as thermoplastic polyurethane, providing a stable surface for stepping exercises. The top surface of the flat deck (1) features anti-slip tracks (2), which supply traction to ensure secure footing during training sessions. It may be provided a handle (8) for easy transportation of the trainer.

Arranged beneath the flat deck (1) is a bottom member (3) having a substantially dome-like shape. This dome-shaped geometry induces rotational forces when the device is placed on a flat surface, thereby challenging the user's balance and stability. The dome is preferably constructed using materials such as resilient thermoplastic polyurethane which allow it to deform and rebound when downward pressure is applied by the user on the flat deck (1).

Importantly, the bottom dome member (3) encases an inflatable chamber which permits adjustments to its rigidity and the rotational forces exerted. The air pressure within this chamber can be easily modified through an inflation nozzle. As the air pressure is increased, the dome becomes more rigid, enhancing the instability and rotational effect. This unique adjustable design caters the device to different skill levels and allows progressive training tailored to the user.

Together, the flat deck (1) providing a non-slip stepping surface and the adjustable dome member (3) enabling multi-axial motion constitute an advanced balance trainer offering unprecedented versatility and customization of proprioceptive training.

Figure 2:
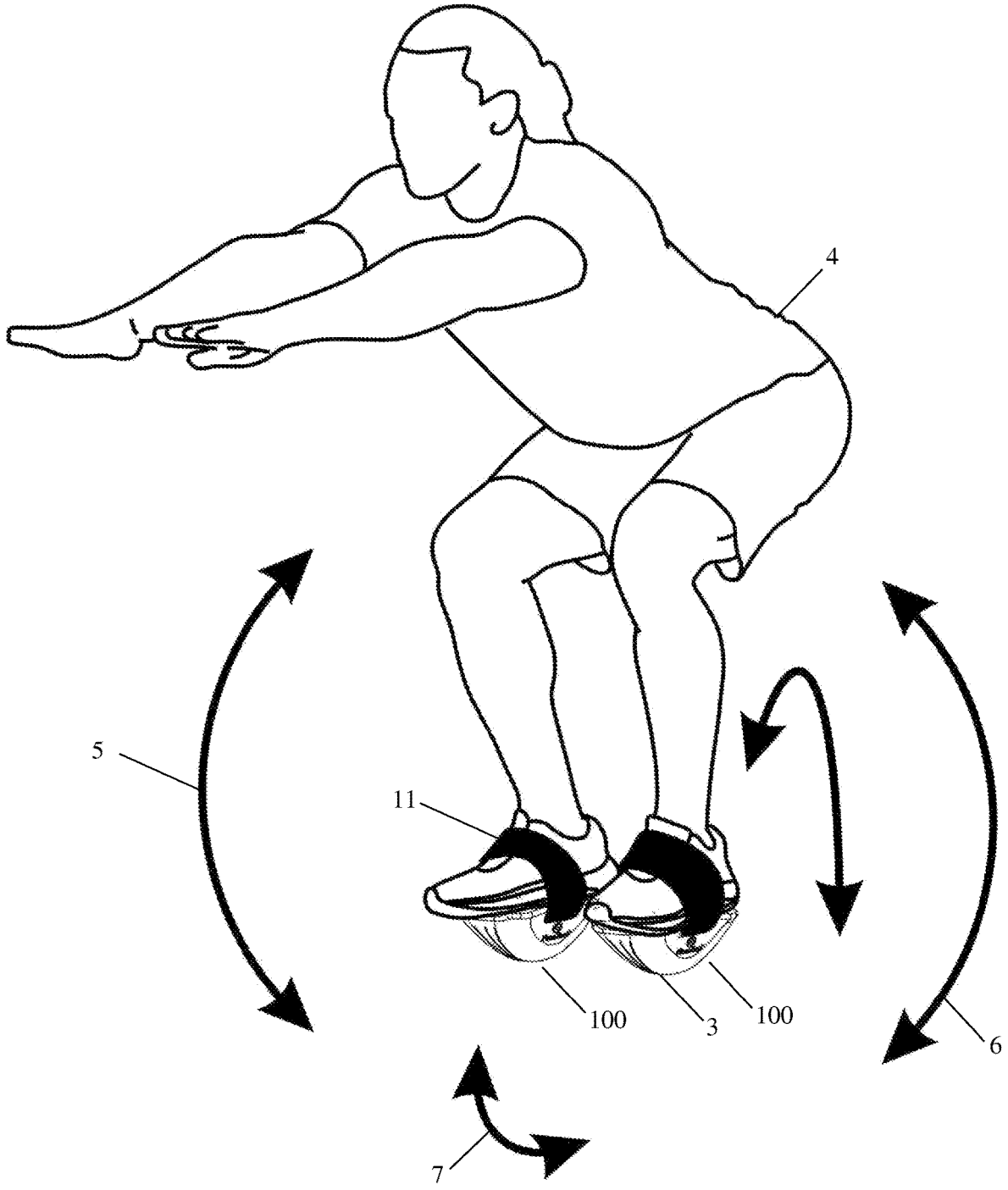
FIG. 2 demonstrates various degrees of rotation about the bottom dome section to challenge the balance of a person on the trainer.

On the other hand, the FIG. 2 demonstrates the adjustability of the multi-axis balance trainer (100) in providing varied instability challenges to the user (4). As depicted, the substantially dome-shaped bottom member (3) permits rotational movements about multiple axes as the user (4) attempts to balance on the flat deck (1).

Specifically, rotational movements in the lateral direction are demonstrated through the arrow orientations (5) and (6) of the device (100). As the dome (3) rotates about its lateral axis, the instability intensifies, testing the user's (4) proprioceptive skills and core engagement. Meanwhile, rotation about the anterior-posterior horizontal axis is shown in arrow orientation (7), indicating the multi-planar motion enabled by the dome's geometry.

In a preferable aspect, as the air pressure within the inflation chamber of the dome (3) is varied, both the ease and extent of these rotations can be adjusted. This allows customization of the training difficulty to match the progress of the user (4) as their balance capabilities improve with continued use of the trainer (100).

As such, the rotational unpredictability and wide scope of motion afforded by this adjustable, dome-based design ensures an engaging and comprehensive balance workout catered to each individual.

Figure 3:
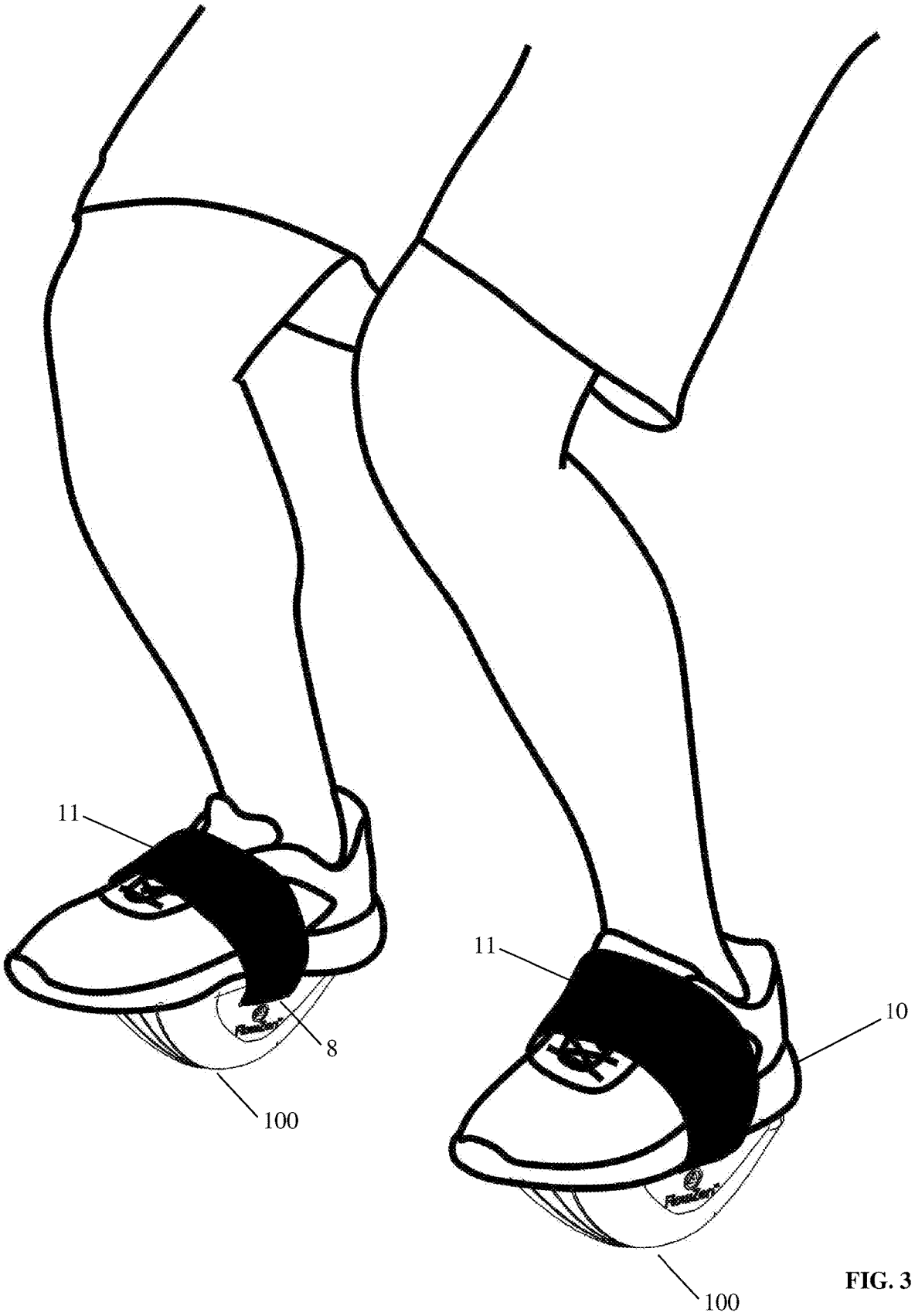
FIG. 3 illustrates a flat deck of the trainer, forming the top portion thereof and being made of a rigid material conducive for stepping.

In another aspect, the FIG. 3 provides a detailed illustration of the flat deck (1) that comprises the top portion of the multi-axis balance trainer (100). As depicted, this deck (1) forms a rigid, durable platform preferable made using thermoplastic polyurethane or similar sturdy materials ideal for fitness activities.

The top surface of the flat deck (1) features anti-slip tracks (2) that supply traction for secure stepping during use. The shoe (10) of a user is placed on the deck (1), and the non-slip surface provides the user's foot with stability afforded. The anti-slip tracks (2) ensure safety for users of various ages and fitness levels while also enabling dynamic movements as part of the balance training process.

The rigid structure and stepping surface (2) of the flat deck (1) provide a stable yet reactive foundation for users to challenge their proprioception and core engagement. As the inflatable dome member deforms with the user's movements, the deck (1) supplies critical and adaptive support, thereby enhancing the device's training potential across skill levels.

In one embodiment, the flat deck (1) and substantially dome-shaped bottom member (3) of the balance trainer (100) are constructed using thermoplastic polyurethane (TPU). TPU is selected for its durable, resilient properties and capacity to rebound from deformations. The bottom member (3) dome geometry may absorb pressures from the user's movements and bounce back to shape to continually challenge balance. Rigid TPU enables the flat deck (1) to provide stable, adaptive support as the bottom dome (3) rotates.

Further embodiments take advantage of the separable top and bottom member design for portability. The dome (3) and flat deck (1) can detach for easy storage in tight spaces. This permits use in compact home environments and better transport to professional training facilities or physical therapy centers. The disassembled components stack together, occupying minimal volume within bags, boxes or storage containers. The secure joining mechanism also ensures the trainer (100) components reattach firmly for training stability when reassembled by the user. This separability thereby expands potential applications and environments for the balance trainer across both personal and clinical spaces.

Embodiments of the multi-axis balance trainer may utilize a variety of materials for constructing the flat deck, dome member and other components. Materials are selected for mechanical properties enabling reliable function including dimensional stability, resilience to deformation and wear.

Alternative embodiments may specify different materials for key sub-assemblies based on performance needs. The dome member in particular necessitates impact resistance and rebound capacity during use. The flat deck however requires rigidity to supply stable footing support when downward pressures are applied.

Additional embodiments encompass balance trainers producible in various sizes and geometric dome curvatures matched to usage scenarios from home fitness to professional training settings. Configurability also suits variable body weights and skill levels across potential consumer demographics including seniors and injury rehabilitation patients.

Assembly methods extend to mechanical fastening or adhesive bonding of trainer components to ensure proper fixture tolerance during manufacturing. Quality assurance processes further verify dome air retention ability, deck traction and multi-axial rotational function prior to batch release.

The applicant intends to encompass all such obvious alternative designs and enhancements tailored for this advanced balance trainer that build on the core concepts disclosed. Interpretations encompass plural forms, and vice versa, unless explicitly stated otherwise. Grammatical conjunctions denote both conjunctive and disjunctive combinations, unless otherwise evident from the context.

INDUSTRIAL APPLICATION

The disclosed invention has broad applicability across the health and wellness sectors. It finds its utility in environments such as fitness centers, home gyms, physical therapy clinics, and sports training facilities. Its adjustable instability levels make it an ideal tool for a wide range of users, from individuals seeking to improve their general fitness and core strength to athletes focusing on enhancing their balance and coordination. Additionally, its application in rehabilitation programs is significant, offering a tailored approach to individuals recovering from injuries or those needing specialized balance training. The compact and adaptable design of the device also makes it suitable for use in space-constrained environments, further broadening its industrial applicability.

What is claimed is:

1. A modular balance training system comprising:

a substantially flat deck forming a top portion thereof, being formed of a substantially rigid member for stepping;

a rigid bottom member arranged beneath the substantially flat deck, the rigid bottom member being substantially dome-shaped, the substantially dome shape configured to induce a rotational force on a user when the rigid bottom member is placed on a surface;

a transversely extending opening adapted to receive and guide a support strap, the transversely extending opening extending through a body of the substantially dome shape of the rigid bottom member; and the support strap adapted to extend through the transversely extending opening;

wherein the rigid bottom member is configured to induce a rotational instability on the user stepping on the substantially flat deck to challenge a balance of the user.

2. The modular balance training system of claim 1, wherein the substantially flat deck forming the top portion comprises a non-slip stepping surface.

3. The modular balance training system of claim 1, wherein a chamber is enclosed by an outer layer of the rigid bottom member.

4. The modular balance training system of claim 1, wherein the substantially flat deck and the rigid bottom member are not separable.

5. The modular balance training system of claim 1, wherein the substantially flat deck and the rigid bottom member are constructed of thermoplastic polyurethane.

6. The modular balance training system of claim 1, wherein the rigid bottom member being substantially dome-shaped is resilient to deformation and rebound when downward pressure is applied.

7. The modular balance training system of claim 1, wherein the rigid bottom member being substantially dome-shaped enables multi-axial rotational motions.

8. The modular balance training system of claim 1, wherein the support strap allows for fastening of a foot of the user to the substantially flat deck.

9. The modular balance training system of claim 8, wherein edges of the substantially flat deck are curved downwards to accommodate a natural arch of a foot of the user.

10. The modular balance training system of claim 8, wherein the fastening of the foot of the user to the substantially flat deck with the support strap allows for dynamic exercises requiring movement by the user.

* * * * *